US008965261B2

(12) United States Patent
Matsuura

(10) Patent No.: US 8,965,261 B2
(45) Date of Patent: Feb. 24, 2015

(54) IMAGE HEATING APPARATUS

(71) Applicant: Canon Kabushiki Kaisha, Tokyo (JP)

(72) Inventor: Daigo Matsuura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 42 days.

(21) Appl. No.: 13/776,410

(22) Filed: Feb. 25, 2013

(65) Prior Publication Data

US 2013/0223903 A1 Aug. 29, 2013

(30) Foreign Application Priority Data

Feb. 27, 2012 (JP) ..... 2012-040369

(51) Int. Cl.
*G03G 15/20* (2006.01)

(52) U.S. Cl.
CPC ..... *G03G 15/2025* (2013.01); *G03G 15/2053* (2013.01); *G03G 2215/2035* (2013.01)
USPC ..... 399/329; 399/320; 399/338; 219/216

(58) Field of Classification Search
USPC ..... 399/122, 320, 329, 330; 219/216
See application file for complete search history.

(56) References Cited

U.S. PATENT DOCUMENTS

| | | | | |
|---|---|---|---|---|
| 5,051,784 | A * | 9/1991 | Yamamoto et al. | 399/329 |
| 6,564,033 | B2 * | 5/2003 | Zhou et al. | 399/329 |
| 2005/0185996 | A1 * | 8/2005 | Oishi et al. | 399/329 |
| 2007/0071522 | A1 * | 3/2007 | Kaji et al. | 399/329 |
| 2011/0206426 | A1 * | 8/2011 | Komuro | 399/329 |
| 2012/0155932 | A1 * | 6/2012 | Nakamura et al. | 399/329 |

FOREIGN PATENT DOCUMENTS

| | | | | |
|---|---|---|---|---|
| JP | 2002225051 A | * | 8/2002 | B29C 41/02 |
| JP | 2010-026489 A | | 2/2010 | |

* cited by examiner

*Primary Examiner* — Francis Gray
(74) *Attorney, Agent, or Firm* — Canon USA Inc IP Division

(57) ABSTRACT

An image heating apparatus includes a rotatable endless belt, an opposing member forming a nip together with an outer surface of the belt, and a non-rotatable pressure applying member that contacts an inner surface of the belt and is pressed toward the opposing member. A recording paper carrying an image is nipped and conveyed through the nip to be heated and pressed. The pressure applying member has a metal slide contact portion against which the inner surface of the belt slides. Rz, the ten-point average roughness, of the slide contact portion in a belt movement direction is 0.29 μm or smaller and smaller than that in a direction perpendicular to the belt movement direction. Rz of the inner surface of the belt in the belt movement direction is 1.3 μm or larger and larger than that in a direction perpendicular to the belt movement direction.

11 Claims, 7 Drawing Sheets

IMAGE HEATING APPARATUS

BACKGROUND OF THE INVENTION

1. Field of the Invention

The present invention relates to image heating apparatuses that heat toner images on sheets. Such image heating apparatuses may be used in image forming apparatuses such as, for example, copiers, printers, facsimile machines, and multi-function machines equipped with a plurality of functions of these devices.

2. Description of the Related Art

Electrophotographic image forming apparatuses perform an electrophotographic process in which toner images are fixed on recording paper (sheets) through charging, exposing, developing, and fixing steps. As an example of fixing apparatuses (image heating apparatuses) that perform the fixing step, in Japanese Patent Laid-Open No. 2010-26489, a fixing apparatus to which a fixing belt method is applied is proposed. With this fixing apparatus, heat capacity is decreased by using a thin fixing belt (endless belt).

In the fixing apparatus described in Japanese Patent Laid-Open No. 2010-26489, a nip portion is formed by the fixing belt and a pressure roller, and a pressure pad that presses the fixing belt in a direction from the inner surface of the fixing belt toward the pressure roller is provided.

In such a fixing apparatus, the inner surface of the fixing belt and the pressure pad are in a relationship in which the fixing belt slides against the pressure pad as the fixing belt is rotated, and accordingly, the inner surface of the fixing belt and the pressure pad tend to wear off.

In order to address this, in the fixing apparatus described in Japanese Patent Laid-Open No. 2010-26489, lubricant (fluorine-based grease) is applied between the inner surface of the fixing belt and the pressure pad, and layers formed of a fluorine-based resin are provided on the inner surface of the fixing belt and the pressure pad.

However, nowadays, with increasing demand for fixing apparatuses with which operational speed and image quality are increased, the pressure at the nip portion is desirably set to be higher than that of the related art. In this regard, there is a concern as described below regarding the structure of the fixing apparatus described in Japanese Patent Laid-Open No. 2010-26489.

That is, the fluorine-based resin layers coated on the inner surface of the fixing belt and the pressure pad may significantly wear off due to increased pressure at the nip portion, and accordingly, torque for rotating the fixing belt may be increased. As a result, a self-induced vibration referred to as stick-slip occurs in a portion where the fixing belt slides against the pressure pad. When the degree of stick-slip becomes non-negligible, the user may feel uncomfortable with noise caused by stick-slip (such a phenomenon is referred to as "squeal" herein).

This phenomenon is caused by the fact that particles of the fluorine-based resin, which are produced as a result of the fluorine-based resin layers sliding against each other and being rubbed off, contribute to an effect by which wear on the fluorine-based resin is decreased. When considering use of the fixing apparatus for a long time in view of the above-described characteristics, the thicknesses of the fluorine-based resin layers needs to be significantly increased. This is not a realistic measure.

Furthermore, lubricant, which is present in a portion where the fixing belt slides against the pressure pad, is repelled due to the characteristics of the fluorine-based resin with which the fixing belt and the pressure pad are coated, thereby degrading the lubricating effects produced by the lubricant.

As described above, even when suppression of wear caused by sliding of the fixing belt against the pressure pad is attempted by coating the fixing belt and the pressure pad with a fluorine-based resin, such a measure is not sufficiently effective.

SUMMARY OF THE INVENTION

An image heating apparatus according to an aspect of the present invention includes an endless belt that heats a toner image on a sheet in a nip portion, an opposing member that is disposed opposite the endless belt and forms the nip portion together with the endless belt therebetween, and a pressure pad that presses the endless belt toward the opposing member. In the image heating apparatus, the pressure pad has a metal slide contact portion, an inner surface of the endless belt slides against the slide contact portion, and a lubricant is applied to the slide contact portion. In the image heating apparatus, when a surface roughness of the slide contact portion in a movement direction of the endless belt is denoted by Rzp and a surface roughness of the inner surface of the endless belt in the movement direction of the endless belt is denoted by Rzb, the following relationship is satisfied: $Rzp<Rzb$.

The present invention provides an image heating apparatus in which wear on the endless belt and the pressure pad, which is caused by sliding of the endless belt against the pressure pad, can be appropriately suppressed.

Further features of the present invention will become apparent from the following description of exemplary embodiments with reference to the attached drawings.

DESCRIPTION OF THE EMBODIMENTS

Embodiments according to the present invention will be more specifically described below. Although the embodiments described hereafter are examples of embodiments according to the present invention, the present invention is not limited by these embodiments. A variety of structures of the embodiments may be replaced with different known structures without departing from the spirit of the present invention.

First Embodiment (1) Example of Image Forming Apparatus

Figure 1:
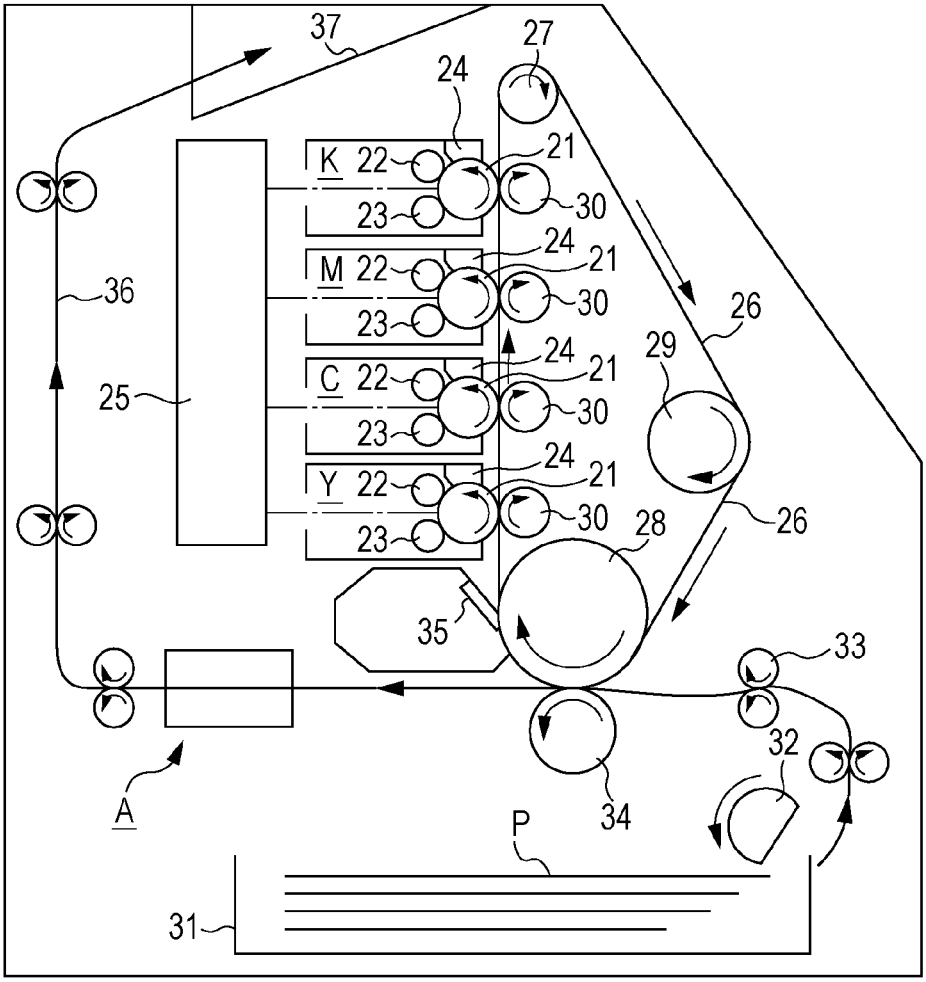
FIG. 1 is a schematic view of the structure of an image forming apparatus according to a first embodiment.

FIG. 1 is a schematic view of the structure of an example of an image forming apparatus in which an image heating apparatus according to the present invention is installed as a fixing apparatus. This image forming apparatus is a color image forming apparatus (color printer) to which an electrophotographic method is applied. Four electrophotographic image forming units Y, C, M, and K, which respectively form yellow, cyan, magenta, and black color toner images, are provided sequentially in this order from bottom to top in the image forming apparatus. Each of the photographic image forming units Y, C, M, and K includes a photosensitive drum 21, a charger 22, a developing device 23, a cleaning device 24, and the like.

The developing devices 23 of the image forming units Y, C, M, and K respectively contain yellow, cyan, magenta, and black toners.

An optical unit 25 is provided for the above-described four image forming units Y, C, M, and K. The photosensitive drums 21 are exposed to light by using the optical unit 25, thereby forming electrostatic latent images. As an optical system, a laser scanning exposure optical system is used. In each of the image forming units Y, C, M, and K, the photosensitive drum 21, which has been uniformly charged by the charger 22, is subjected to scanning exposure performed by the optical unit 25 in accordance with image data. Thus, an electrostatic latent image corresponding to an image pattern in scanning exposure is formed on the surface of the photosensitive drum 21.

The electrostatic latent images are developed into toner images by the developing devices 23. That is, an yellow toner image is formed on the photosensitive drum 21 of the image forming unit Y, a cyan toner image is formed on the photosensitive drum 21 of the image forming unit C, a magenta toner image is formed on the photosensitive drum 21 of the image forming unit M, and a black toner image is formed on the photosensitive drum 21 of the image forming unit K.

The color toner images formed on the photosensitive drums 21 of the image forming units Y, C, M, and K are transferred through primary transfer onto an intermediate transfer member 26 with the toner images sequentially superposed with one another in a predetermined alignment state. The intermediate transfer member 26 is rotated at substantially the same speed as rotation of the photosensitive drums 21 in synchronization with the photosensitive drums 21. Thus, the color toner images are combined to form an unfixed full color toner image on the intermediate transfer member 26. In the present embodiment, the intermediate transfer member 26 uses an endless intermediate transfer belt. The intermediate transfer belt 26 is looped over three rollers, that is, a drive roller 27, a secondary transfer roller opposing roller 28, and a tension roller 29 so as to be stretched, and is driven by the drive roller 27.

Primary transfer of toner images from the photosensitive drums 21 of the image forming units Y, C, M, and K onto the intermediate transfer belt 26 is performed by using primary transfer units. The primary transfer units use primary transfer rollers 30. A primary transfer bias, the polarity of which is opposite to that of toner, is applied from a bias power supply (not shown) to each primary transfer roller 30. Thus, toner images are transferred from the photosensitive drums 21 of the image forming units Y, C, M, and K to the intermediate transfer belt 26 through primary transfer. After primary transfer from the photosensitive drums 21 of the image forming units Y, C, M, and K to the intermediate transfer belt 26 has been performed, toner remaining on the photosensitive drums 21 as residual toner is removed by the cleaning devices 24.

The above-described step is performed in synchronization with rotation of the intermediate transfer belt 26 for yellow, magenta, cyan, and black colors, so that primary transfer toner images in these colors are sequentially superposed with one another on the intermediate transfer belt 26. In order to form a monochrome image (monochrome mode), the above-described step is performed for a single target color.

A feeding roller 32 separates one sheet after another from recording paper (recording media or sheets) P loaded in a cassette 31 and feeds each of the sheets at a predetermined control timing. A sheet of the paper P is conveyed to a secondary transfer nip portion by a registration roller 33 at a predetermined timing. The secondary transfer nip portion serves as a pressure contact portion where part of the intermediate transfer belt 26 running on the secondary transfer roller opposing roller 28 and a secondary transfer roller 34 are in pressure contact with each other.

A primary transfer combination toner images formed on the intermediate transfer belt 26 are transferred onto sheets of recording paper P being nipped and conveyed in the secondary transfer nip portion. In secondary transfer, toner images of a single primary transfer combination toner image are collectively transferred, and primary transfer combination toner images are sequentially transferred to sheets of recording paper P. Secondary transfer is electrostatically performed by a bias, the polarity of which is opposite to that of toner, applied from a bias power supply (not shown) to each secondary transfer roller 34. The recording paper P conveyed out of the secondary transfer nip portion is separated from the intermediate transfer belt 26 and introduced into a fixing apparatus A that serves as an image heating apparatus. The recording paper P introduced into the fixing apparatus A undergoes a process, in which the toners of the unfixed toner image having been transferred onto the recording paper P through secondary transfer are melted, mixed, and fixed, and, as a result, the recording paper P carries full-color printing. Then, the recording paper P passes through a paper ejection path 36 and is fed to a paper output tray 37.

The secondary transfer residual toner remaining on the intermediate transfer belt 26 after secondary transfer has been performed is removed by an intermediate transfer belt cleaner 35.

(2) Fixing Apparatus A

In the following description, the lengthwise direction of the fixing apparatus A that functions as the image heating apparatus or components thereof refers to a direction parallel to a direction perpendicular to a recording paper conveying direction in a nip portion N. The lengthwise direction may also be referred to as a fixing belt width direction as will be described later. The widthwise direction refers to a direction parallel to the recording paper conveying direction and may also be referred to as a fixing belt movement direction (circumferential direction). Regarding the fixing apparatus A, a front surface of the fixing apparatus A refers to a surface when the fixing apparatus A is seen from a recording paper entry side, a rear surface of the fixing apparatus A refers to a surface opposite to the front surface (recording paper exit side), and the left and right refers to the left and right when the fixing apparatus A is seen from the front surface. The upstream and downstream sides are defined with respect to the recording paper conveying direction.

Figure 2A:
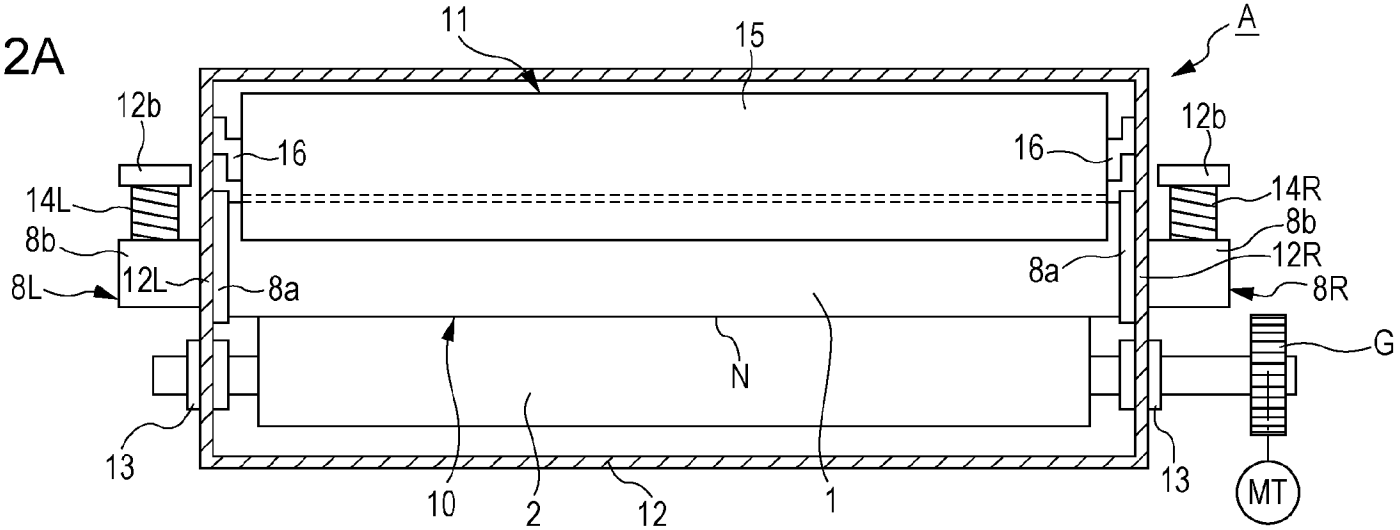
FIG. 2A is a schematic front view of a fixing apparatus according to the first embodiment.
Figure 2B:
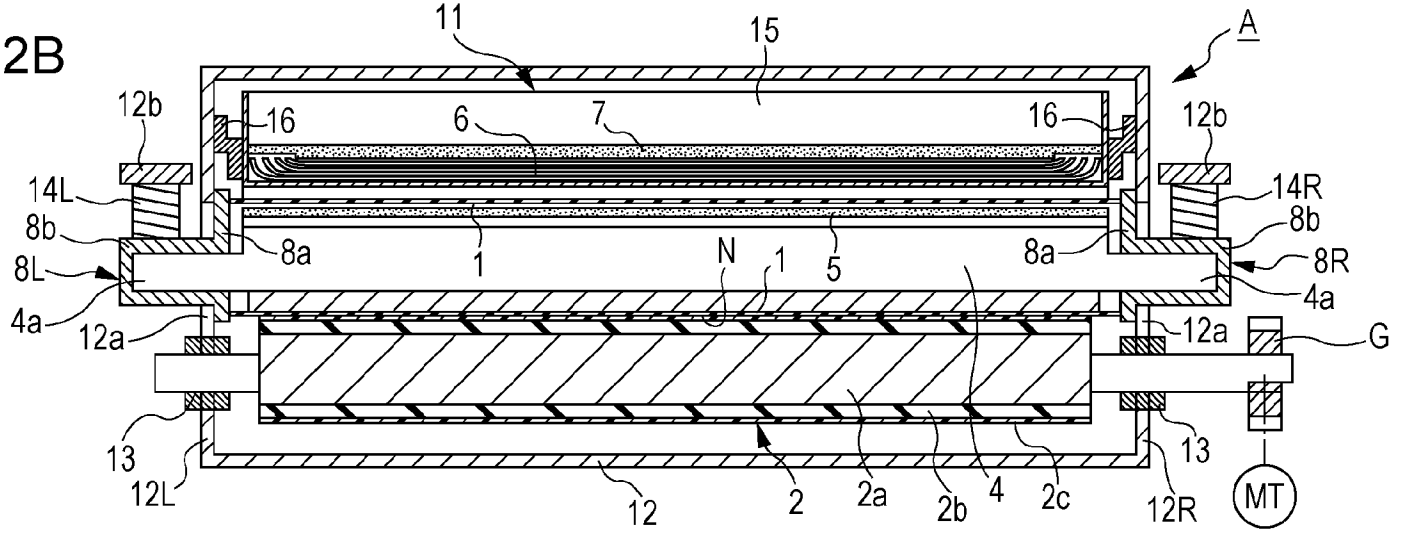
FIG. 2B is a schematic longitudinal sectional front view of the fixing apparatus according to the first embodiment.
Figure 3:
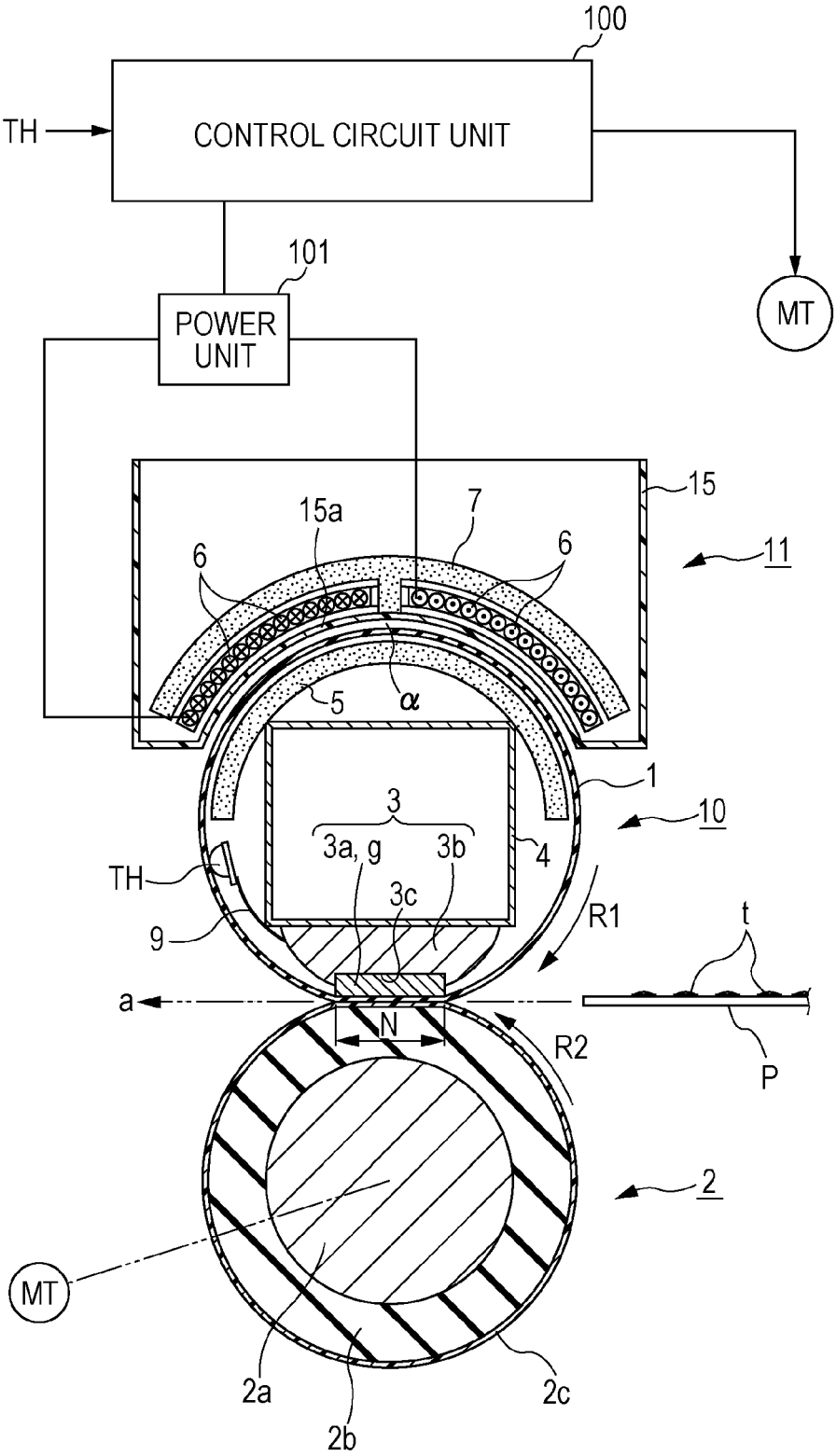
FIG. 3 is an enlarged cross-sectional schematic view of a main portion of the fixing apparatus according to the first embodiment.

FIG. 2A is a schematic front view of the fixing apparatus A, and FIG. 2B is a schematic longitudinal sectional front view of the fixing apparatus A. FIG. 3 is an enlarged cross-sectional schematic view of a main portion of the fixing apparatus A. The fixing apparatus A according to the present embodiment is a belt-type image heating apparatus using external-heating by an electromagnetic induction heating method.

The fixing apparatus A generally includes a belt unit 10, an elastic pressure roller (pressure member) 2, and a coil unit 11.

The belt unit 10 includes an endless belt member, which is rotatably provided. The pressure roller 2 serves as an opposing member (nip forming member). The coil unit 11 serves as a heating mechanism (magnetic field producer). The belt unit 10, the pressure roller 2, and the coil unit 11 are attached to an apparatus chassis 12 (apparatus frame).

(2-1) Belt Unit 10

Figure 4:
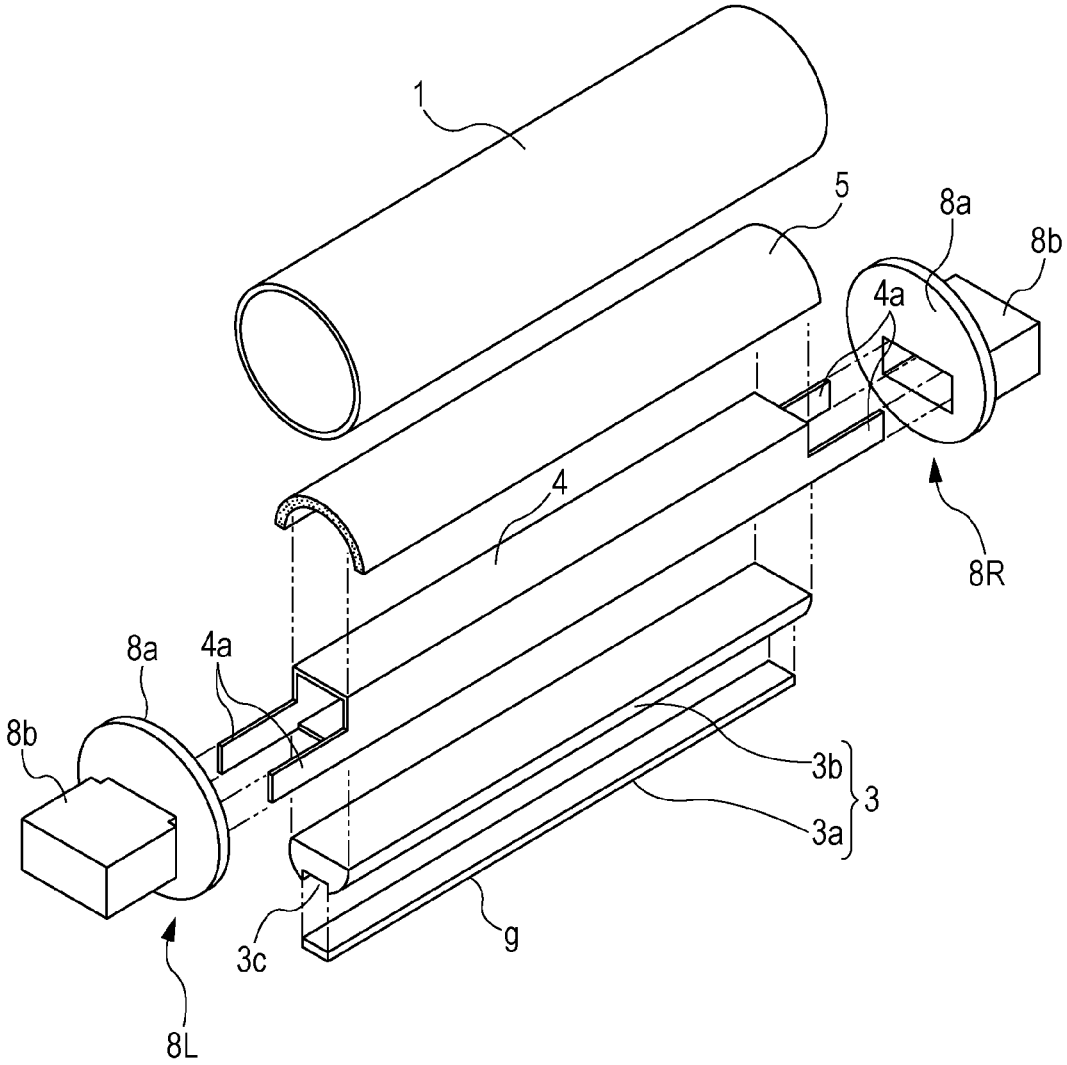
FIG. 4 is an exploded perspective view of a belt unit.

FIG. 4 is an exploded perspective view of the belt unit 10. As described above, the belt unit 10 includes an endless belt member 1 (referred to as a "fixing belt 1" hereafter), which is rotatably provided. The fixing belt 1 is formed of a magnetic member (metal layer, electrically conductive member) that performs electromagnetic induction heating when passing through a region where a magnetic field generated by the coil unit 11, which will be described later, exists. The belt unit 10 also includes a metal stay 4 inserted into the fixing belt 1. The stay 4, which needs to have rigidity in order to apply pressure to the fixing nip portion N, is formed of iron in the present embodiment. Specifically, the stay 4 uses a hollow preformed material having a rectangular cross section and rigidity.

A pressure pad (pressure applying member) 3 is secured to a lower surface of the stay 4 in the lengthwise direction of the stay 4. The pressure pad 3 does not substantially rotate during fixing (while the fixing belt 1 is rotated). The pressure pad 3 causes pressure to act between the fixing belt 1 and the pressure roller 2 so as to form the fixing nip portion N. The pressure pad 3 includes a metal secured member (slide contact portion) 3*a* and a holding member (heat insulating member) 3*b*. The secured member 3*a* rubs a sliding layer 1*d* (see FIG. 5) formed on an inner surface side of the fixing belt 1. The holding member 3*b* holds the secured member 3*a* and prevents heat from being released to the stay 4. A lubricant g is applied to the secured member 3*a* (inner surface of the fixing belt 1). More details of the pressure pad 3 will be described later. Unlike an apparatus described in aforementioned Japanese Patent Laid-Open No. 2010-26489, the secured member 3*a*, which is formed of metal, is not coated with a fluorine-based resin or not covered with a sheet-like material having a low sliding property in the present embodiment.

A magnetic shielding core 5 having a substantially semi-arc shaped cross section is disposed on the upper surface side of the stay 4 in the lengthwise direction of the stay 4. The magnetic shielding core 5 serves as a magnetic shielding member and is provided to prevent the temperature of the stay 4 from increasing through induction heating due to the effects of the magnetic field generated by the coil unit 11.

The stay 4 has extension arms 4*a* at the left and right ends thereof. The extension arms 4*a* protrude outward from the left and right ends of the fixing belt 1. Flange members 8L and 8R, which have shapes bilaterally symmetrical to each other, are respectively fitted onto the left and right extension arms 4*a*. The fixing belt 1 is loosely looped over the above-described stay 4, the pressure pad 3, and the core 5, which are integrated with one another. Flange portions 8*a* of the left and right flange members 8L and 8R regulate the movement of the fixing belt 1 in the lengthwise direction and the shape of the fixing belt 1 in the circumferential direction.

A temperature sensor TH is disposed in a central portion in the lengthwise direction of the pressure pad 3 through an elastic support member 9. The temperature sensor TH serves as a temperature detector (temperature detecting element) that detects the temperature of the fixing belt 1 and uses a thermistor or the like. The temperature sensor TH elastically contacts the inner surface of the fixing belt using the elastic support member 9. Thus, when there is a change in position of the surface of the fixing belt 1 in contact with the temperature sensor, for example, waving of the surface of the fixing belt 1, the temperature sensor TH can follow the change, and accordingly, a good contacting state is maintained.

The belt unit 10 is disposed between left and right side plates 12L and 12R of the apparatus chassis 12 such that pressure receiving portions 8*b* of the left and right flange members 8L and 8R are respectively engaged with vertical guide slit portions 12*a* (see FIG. 2B) provided in the side plates 12L and 12R. Thus, the belt unit 10 has a freedom of travel in the up-down directions along the vertical guide slit portions 12*a* between the left and right side plates 12L and 12R.

Figure 5:
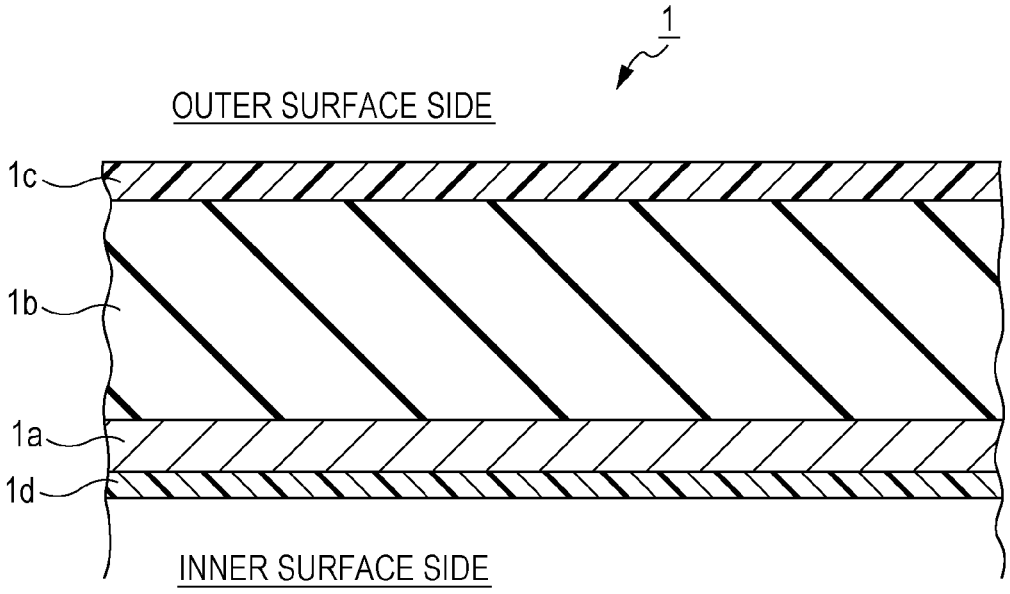
FIG. 5 is a schematic view of the structure of layers of a fixing belt.

FIG. 5 is a schematic view of a layer structure of the fixing belt 1. The fixing belt 1 has a nickel base layer (metal layer) 1*a* formed by an electroforming method and having an inner diameter of 30 mm. The thickness of the base layer 1*a* is 40 μm. The base layer 1*a* of the fixing belt 1 may alternatively be formed of an appropriately selected material other than nickel, for example, an iron alloy, copper, or silver. The thickness of the base layer 1*a* may be adjusted in accordance with the frequency of a high-frequency current flowing through an excitation coil 6 of the coil unit 11, which will be described later, and the magnetic permeability and electrical conductivity of the base layer 1*a*. The thickness of the base layer 1*a* is preferably set to about 5 to 200 μm. When a thin metal layer is used, the base layer 1*a* may be formed by stacking a metal layer on a resin substrate.

A heat-resistant silicone rubber layer as an elastic layer 1*b* is provided at an outer circumference of the base layer 1*a*. The thickness of the silicone rubber layer is preferably set within a range from 100 to 1000 μm. In the present embodiment, the thickness of the silicone rubber layer is set to 300 μm in order to decrease the heat capacity of the fixing belt 1 for decreasing warm-up time and to obtain a good fixed image when a color image is fixed. The silicone rubber layer has a hardness of Japanese Industrial Standards (JIS) A hardness of 20 and heat conductivity of 0.8 W/mK. Furthermore, fluorine-based resin layer (for example, a perfluoroalkoxy (PFA) layer or a polytetrafluoroethylene (PTFE) layer) having a thickness of 30 μm is provided at an outer circumference of the elastic layer 1*b* as a mold release surface layer 1*c*.

The sliding layer 1*d* is provided on an inner surface side of the base layer 1*a*. As will be described later, in consideration of a sliding property and wear resistance, the sliding layer 1*d* can be formed of heat-resistant resin having a thickness of about 2 to 50 μm. When the sliding layer 1*d* is coated with a fluorine-based resin, the lubricant g, which is a fluorine-based grease and applied over the secured member (slide contact portion) 3*a* of the pressure pad 3, is repelled, and accordingly, the lubricant g is not satisfactorily held. Thus, coating the sliding layer 1*d* with a fluorine-based resin is not desired.

In the present embodiment, the sliding layer 1*d* is a polyimide resin layer having a thickness of 15 μm so as to meet demands for heat resistance and wear resistance. The Vickers hardness of the sliding layer 1*d* is 12 HV. By making the sliding layer 1*d* softer than the secured member 3*a*, the sliding distance (wear distance) per unit area of which tends to be increased, a member against which the sliding layer 1*d* slides becomes unlikely to wear off even when a ten-point average roughness Rz is increased in order to supply the lubricant g to a nip (pressure contact portion where the secured member 3*a* of the pressure pad 3 and the sliding layer 1*d* are in contact with each other). That is, the Vickers hardness of the sliding layer 1*d* can be smaller than that of the secured member 3*a*. In the present embodiment, the Vickers hardness is measured with Fischer Scope HM2000 made by Helmut Fischer GmbH Co. KG.

Furthermore, in the present embodiment, the surface roughness Rz of the inner surface (sliding layer 1*d*) of the fixing belt 1 is increased. This improves the performance of the inner surface of the fixing belt 1, the performance being a performance at which the lubricant g is transported to the nip portion (supplying ability), is increased. Such a surface roughness Rz (lubricant supplying ability to the nip portion) of the inner surface of the fixing belt 1 can be maintained for a long time.

Specifically, the surface roughness Rz↓ (Rzp) of the slide contact surface (surface against which the fixing belt 1 slides) of the pressure pad 3 in the widthwise direction (fixing belt movement direction) is made to be smaller than the surface roughness Rz↓ (Rzb) of the inner surface (sliding layer 1*d*) of the fixing belt 1 in the widthwise direction (fixing belt movement direction).

In so doing, the surface roughness Rz↓ (Rzb) of the inner surface (sliding layer 1*d*) of the fixing belt 1 in the widthwise direction is preferably set to equal to or larger than 1.3 μm. The surface roughness Rz↓ (Rzp) of the slide contact surface of the pressure pad 3 in the widthwise direction is preferably set to equal to or smaller than 0.29 μm.

Next, anisotropy of the surface roughness Rz of the sliding layer 1*d* of the fixing belt 1 is described.

Regarding the surface roughness of the sliding layer 1*d* of the fixing belt 1, by increasing the surface roughness Rz↓ (Rzb) in the widthwise direction (fixing belt movement direction), the lubricant g is easily held on the sliding layer 1*d*. This is desirable because the lubricant supplying ability into the nip portion can be improved.

Furthermore, by decreasing the surface roughness Rz→ (Rzb') of the sliding layer 1*d* of the fixing belt 1 in the lengthwise direction (fixing belt width direction), the lubricant g is unlikely to be moved out of recesses formed in the lengthwise direction. This is desirable because the ability of holding the lubricant g in the nip portion can be improved.

Thus, in the sliding layer 1*d* of the fixing belt 1, the surface roughness Rz can be larger in the widthwise direction (fixing belt movement direction or circumferential direction) than in the lengthwise direction (direction perpendicular to the fixing belt movement direction). As a result, when the fixing belt 1 is rotated, the lubricant g is held in the deep grooves formed in the widthwise direction, and accordingly, the lubricant g can be efficiently supplied into the nip portion from the outside of the nip portion.

For the reason as described above, in the structure according to the present embodiment, the ten-point average roughness Rz in the widthwise direction of the inner surface of the sliding layer 1*d*, which is the inner surface layer of the fixing belt 1, is set to 1.3 to 13 μm (equal to or larger than 1.3 μm). In addition, the relationship between Rz↓ (Rzb) in the widthwise direction and Rz→ (Rzb') in the lengthwise direction is set so that Rz↓>Rz→ is satisfied.

In the present embodiment, after the polyimide layer of the inner surface of the sliding layer 1*d* has been formed, the inner surface is polished with a polishing stick, which has been blasted, in the lengthwise direction so that the inner surface has the above-described ten-point average roughness Rz. When metal such as copper is stacked on the resin substrate as the base layer 1*a*, the surface of an inner mold used for molding resin substrate may be roughened.

(2-2) Pressure Roller 2

The pressure roller 2, which functions as a drive mechanism that rotates the fixing belt 1, is an opposing member that forms the nip portion together with the outer surface of the fixing belt 1, which serves as the belt member on the belt unit 10 side. The pressure roller 2 is rotatably provided between the left and right side plates 12L and 12R of the apparatus chassis 12 through bearings 13 below the belt unit 10 such that the axial direction of the pressure roller 2 is substantially parallel to the lengthwise direction of the belt unit 10.

In the present embodiment, the pressure roller 2 is an elastic roller having an outer diameter of 30 mm. The pressure roller 2 is formed of an iron alloy cored bar 2*a*, the diameter of which is 20 mm in a central portion in the lengthwise direction and 19 mm at both ends in the lengthwise direction, and a silicone rubber layer as an elastic layer 2*b* provided around the cored bar 2*a*. A fluorine-based resin layer (for example, a PFA layer or a PTFE layer) having a thickness of 30 μm is provided on the surface of the pressure roller 2 as a mold release surface layer 2*c*. The hardness of the pressure roller 2 in the central portion in the lengthwise direction is ASKER C hardness of 70.

Pressure springs 14L and 14R are compressed and provided between the pressure receiving portions 8*b* of the left and right flange members 8L and 8R on the belt unit 10 side and spring receiving portions 12*b* on the apparatus chassis 12 side. Pressing down forces are applied to the left and right end sides of the stay 4 due to reaction forces of the pressure springs 14L and 14R. This causes the lower surface of the pressure pad 3 and the upper surface of the pressure roller 2 to be in pressure contact with each other against the elasticity of the pressure roller 2 with the fixing belt 1 nipped therebetween. Thus, the fixing nip portion (nip portion) N is formed between the fixing belt 1 and the pressure roller 2 having a predetermined width in the recording paper conveying direction a.

The cored bar 2*a* of the pressure roller 2 is tapered so that pressure is uniformly applied in the lengthwise direction at the fixing nip portion N formed due to pressure contact of the fixing belt 1 and the pressure roller 2 with each other even when the pressure pad 3 is bent by pressure applied thereto. In the present embodiment, the width of the fixing nip portion N is about 8.5 mm in the central portion in the lengthwise direction and about 9 mm at both the end portions in the lengthwise direction under a nip pressure of 600 N. This is advantageous in that creases are unlikely to be formed in the recording paper P because both the end portions of the recording paper P are conveyed at a speed higher than the speed at which a central portion of the recording paper P is conveyed.

A drive gear G is secured to the right side end portion of the cored bar 2*a*. A drive force of a fixing motor MT, which is controlled by a control circuit unit 100, is transmitted to the gear G via a gear train, thereby rotating the pressure roller 2 counterclockwise as indicated by an arrow R2 in FIG. 3 at a predetermined speed.

When the pressure roller 2 is rotated, a rotational force is applied to the fixing belt 1 due to a frictional force produced between the surface of the pressure roller 2 and the surface of the fixing belt 1 in the fixing nip portion N. The fixing belt 1 is driven to rotate at the substantially same speed as the rotational speed of the pressure roller 2 around the outer peripheries of the stay 4, the pressure pad 3, and the core 5 clockwise as indicated by an arrow R1 in FIG. 3 while the inner surface thereof is in tight contact with and slides against the lower surface of (slide contact portion) of the pressure pad 3.

(2-3) Coil Unit 11

The coil unit 11 is a heat source (induction heating device) that heats the fixing belt 1 through induction heating. The coil unit 11 is disposed on the upper surface side of the belt unit 10 such that the position of the coil unit 11 is fixed relative to the left and right side plates 12L and 12R of the apparatus chassis 12. The coil unit 11 includes the excitation coil 6, a magnetic core 7, and the like attached inside a housing 15, which is elongated along the fixing belt 1.

The housing 15 is a heat-resistant resin molded product (a molded member formed of electrically insulative resin) that has a laterally elongated box shape extending in the left-right direction. The housing 15 has a bottom plate 15*a*, and the bottom plate 15*a* side of the housing 15 opposes the fixing belt 1. In cross-sectional view, the bottom plate 15*a* is curved toward the inside of the housing 15 so as to face the fixing belt 1 over a range substantially half the circumference of the outer surface of the fixing belt 1. The bottom plate 15*a* side of the housing 15 opposes the upper surface of the fixing belt 1 with a predetermined gap $\alpha$ therebetween and the left and right ends of the housing 15 are secured to the left and right side plates 12L and 12R with brackets 16.

The coil 6 uses, for example, a Litz wire as an electrical wire, which is wound into a laterally elongated ship-bottom shape so as to oppose the circumferential surface and part of side surfaces of the fixing belt 1. The coil 6 thus formed is disposed inside the housing 15 such that the coil 6 is in contact with the inner surface of the housing bottom plate 15*a* that curves toward the inside of the housing 15. A high-frequency current at 20 to 50 kHz is applied to the coil 6 from a power unit (excitation circuit) 101 controlled by the control circuit unit 100. The core 7 is an outer magnetic core that covers the coil 6 so that magnetic field generated by the coil 6 substantially does not leak to areas other than the metal layer (electrically conductive layer) of the fixing belt 1.

(2-4) Fixing Sequence

When the image forming apparatus is in a standby state, the fixing motor MT is turned off and rotation of the pressure roller 2 is stopped in the fixing apparatus A. Accordingly, rotation of the fixing belt 1 is also stopped. The control circuit unit 100 causes the fixing motor MT to be turned on in accordance with input of an image forming start signal. Thus, the pressure roller 2 is rotated counterclockwise as indicated by the arrow R2 in FIG. 3 at a predetermined rotational speed. Due to this rotation of the pressure roller 2, the fixing belt 1 is driven to rotate clockwise as indicated by the arrow R1 at the same speed as the rotational speed of the pressure roller 2. The movement in the thrust direction due to rotation of the fixing belt 1 is regulated by the flange portions 8*a* of the left and right flange members 8L and 8R.

The fixing belt 1 is, at least when performing image forming, is driven to rotate as described above by rotation of the pressure roller 2 caused by the fixing motor MT controlled by the control circuit unit 100. This rotation of the fixing belt 1 is performed at the substantially same circumferential speed as a conveying speed of the recording paper P that carries an unfixed toner image t and is conveyed from the secondary transfer nip portion side.

The control circuit unit 100 causes the power unit 101 to supply an alternating current (high-frequency current) of, for example, 20 to 500 kHz to the coil 6. An alternating magnetic flux (magnetic field) is generated by the coil 6 when the alternating current is supplied to the coil 6. The alternating magnetic flux is introduced to the base layer 1*a* of the fixing belt 1 by the core 7 located on the upper side of the fixing belt 1 while the fixing belt 1 is being rotated. As a result, eddy currents are generated in the base layer 1*a*. The eddy current causes Joule heat to be generated. The base layer 1*a* undergoes self-heating (electromagnetic induction heating) due to Joule heat, and accordingly, the temperature of the fixing belt 1 is increased.

That is, while the fixing belt 1 is being rotated, the base layer 1*a* of the fixing belt 1 is heated by electromagnetic induction when passing through a region where the magnetic field generated by the coil unit 11 exists, thereby heating the entire circumference of the fixing belt 1. Thus, the temperature of the fixing belt 1 is increased. In the present embodiment, the fixing belt 1 and the coil 6 of the coil unit 11 are electrically insulated from each other by the housing bottom plate (mold) 15*a* having a thickness of 0.5 mm. The distance between the fixing belt 1 and the coil 6 are constantly maintained at 1.5 mm (distance (gap $\alpha$) between the surface of the housing bottom plate 15*a* and the surface of the fixing belt 1 is 1.0 mm) and the fixing belt 1 is uniformly heated.

The temperature of the fixing belt 1 is detected by the temperature sensor TH. The temperature sensor TH detects the temperature of part of the fixing belt 1 running through a paper-feeding region, and feeds back information regarding the detected temperature to the control circuit unit 100. The control circuit unit (temperature control unit) 100 controls power supplied from the power unit 101 to the coil 6 so that the detected temperature (information regarding the detected temperature) received from the temperature sensor TH is maintained at a predetermined target temperature (fixing temperature: information corresponding to the predetermined temperature).

That is, when the detected temperature of the fixing belt 1 is increased to the predetermined temperature, power supply to the coil 6 is interrupted. In the present embodiment, temperature is adjusted so that the temperature of the fixing belt 1 is maintained at 180° C., which is a target temperature of the fixing belt 1, through control of power input to the coil 6, which is performed by changing the frequency of the high-frequency current in accordance with a value detected by the temperature sensor TH.

When the pressure roller 2 is driven and the temperature of the fixing belt 1 is increased and adjusted to the predetermined fixing temperature, the recording paper P that carries the unfixed toner image t is guided by a recording paper conveying guide and introduced into the fixing nip portion N with its toner image carrying surface side facing the fixing belt 1 side. In the fixing nip portion N, the recording paper P is conveyed while being in tight contact with the outer circumferential surface of the fixing belt 1.

As a result, heat is imparted to the recording paper P mainly from the fixing belt 1 and the recording paper P is subjected to pressure in the fixing nip portion N, and accordingly, the unfixed toner image t is heated and pressed against the surface of the recording paper P. Thus, the unfixed toner image t is fixed as a fixed image. The recording paper P having passed through the fixing nip portion N undergoes self-separation (curvature separation) from the outer circumferential surface of the fixing belt 1 due to deformation of the surface of the fixing belt 1 at the exit of the fixing nip portion N and is conveyed to the outside of the fixing apparatus A.

(2-5) Measures against Noise Caused by Stick-Slip

The pressure pad 3, which applies pressure between the fixing belt 1 and the pressure roller 2 so as to form the fixing nip portion N, is pressed by the pressure springs (urging members) 14L and 14R from the ends in the lengthwise direction toward the pressure roller 2. The secured member 3*a* of the pressure pad 3 is the slide contact portion against which the sliding layer 1*d* of the fixing belt 1 slides as the fixing belt 1 rotates. The lubricant (fluorine-based grease) g is applied to the slide contact portion in order to provide lubricity.

The lubricant g is a semi-solid lubricant (referred to as "grease" hereafter) formed of a solid component (compound) and a base oil component (oil). The lubricant g maintains the sliding property of the secured member 3*a* and the sliding layer 1*d* of the fixing belt 1, which slides against the secured member 3*a*.

Examples of the compound of the semi-solid lubricant include solid lubricant such as graphite and molybdenum disulfide, metal oxide such as zinc oxide and silica, and a fluorine-based resin such as perfluoro polyether (PFPE) and PTFE. Any of the above-described materials is added to the grease in the form of powder having a particle size of about 3 μm. Examples of a base oil component include heat-resistant polymer resin oil such as silicone oil and fluorosilicone oil. In the present embodiment, PTFE powder particulates (particle size: 3 μm) is used as the compound included in the grease and grease including fluorosilicone oil is used as oil.

The holding member 3*b* has a recess portion 3*c* in which the secured member 3*a* is held so that the secured member 3*a* as the slide contact portion is not moved by frictional force generated between the secured member 3*a* and the sliding layer 1*d*. That is, the secured member 3*a* that has an elongated plate shape is fitted into the recess portion 3*c* so as to be held. The recess portion 3*c* is formed in a lower surface of the holding member 3*b* in the lengthwise direction. The holding member 3*b* can be formed of a heat-resistant resin material having a low heat conductivity such as polyphenylene sulfide (PPS) or liquid crystal polymer in order to efficiently heat the recording paper P and prevent heat from being released from the fixing nip portion N to the stay 4.

The secured member 3*a* as the slide contact portion is formed of metal. In the present embodiment, the secured member 3*a* is a metal plate having a thickness of 2 mm. The secured member 3*a* is secured in the recess portion 3*c* of the holding member 3*b* so as to maintain the sliding property of the secured member 3*a* and the sliding layer 1*d* of the fixing belt 1, which slides against the secured member 3*a*. In the present embodiment, the secured member 3*a* is formed of stainless steel (SUS304) having a high surface energy so that a wettability with respect to the lubricant (grease) g is maintained, thereby holding the grease g on the slide contact portion.

The measured Vickers hardness of the secured member 3*a* is 195 HV. Since the sliding distance (wear distance) per unit area of the secured member 3*a* tends to increase, by making the secured member 3*a* harder than the sliding layer 1*d*, the secured member 3*a* becomes unlikely to wear.

Here, the anisotropy of the surface roughness Rz (ten-point average roughness) of the slide contact portion (secured member 3*a*) of the pressure pad 3 is described.

Rz↓ (Rzp) of the secured member 3*a* in the widthwise direction (fixing belt movement direction) can be decreased in order to suppress wear on the inner surface (sliding layer 1*d*) of the fixing belt 1, the inner surface being roughened in order to improve the lubricant supplying ability to the nip portion. In contrast, Rz→ (Rzp') of the secured member 3*a* in the lengthwise direction (fixing belt width direction) can be increased in order to hold the sufficient lubricant g in the nip portion by making it difficult for the lubricant g to adhere and spread in the lengthwise direction of the secured member 3*a*.

Thus, Rz→ (Rzp') in the lengthwise direction of the secured member 3*a* (fixing belt width direction, direction perpendicular to the fixing belt movement direction) can be larger than the Rz↓ (Rzp) in the widthwise direction of the secured member 3*a*. As a result, the lubricant g is sufficiently held in the recesses of the secured member 3*a*, thereby allowing drive torque required for rotating the fixing belt 1 to be decreased.

Thus, in the structure according to the present embodiment, the ten-point average roughness (Rz) on the side of the surface of the secured member 3*a* against which the sliding layer 1*d* slides is set to 0.01 to 0.29 μm (equal to or smaller than 0.29 μm) in the widthwise direction, and the relationship between Rz↓ (Rzp) in the widthwise direction and the Rz→ (Rzp') in the lengthwise direction is set to Rz↓ (Rzp)<Rz→ (Rzp').

In the present embodiment, the anisotropy of the surface roughness Rz is satisfied by setting the rolling direction of the stainless steel (SUS304) plate, which forms the slide contact portion (secured member 3*a*) of the pressure pad 3, is substantially parallel to the lengthwise direction (fixing belt width direction).

(2-6) Method of Measuring Surface Roughness Rz

The surface roughnesses Rz (ten-point average roughnesses) of the above-described fixing belt 1 (sliding layer 1*d*) and the pressure pad 3 (secured member 3*a*) can be measured by the following method.

Ten-point average roughness, which is so-called $Rz_{JIS}$ ('94JIS), is simply referred to as Rz as described above in the present embodiment. Measurement was performed by using Surfcorder SE3500 (made by Kosaka Laboratory Ltd.) in conformance with JIS B 0601. The measurement was performed under the following conditions: reference length (cut-off length) is 0.8 mm; evaluation length is 4 mm; and feeding speed is 0.2 mm/sec. In the measurement, in order to avoid a situation in which it is difficult for a probe of the roughness meter to follow the shapes of the sliding layer 1*d* and the secured member 3*a*, the lubricant g was not applied.

Specifically, in the case of the fixing belt 1, the cylindrically shaped fixing belt 1 was cut open for measurement. Rz↓ (Rzb) was measured by making the probe of the roughness meter in contact with the inner surface of the fixing belt 1 and moving the probe in the widthwise direction (fixing belt movement direction). Rz→ (Rzb') was measured by making the probe of the roughness meter in contact with the inner surface of the fixing belt 1 and moving the probe in the lengthwise direction (fixing belt width direction). In the lengthwise direction, three measurement positions were set, that is, the center in the lengthwise direction and positions offset from the center by 150 mm toward the left and right ends in the lengthwise directions. Measurement at these positions was performed at three rotational positions spaced apart by 120° in the fixing belt movement direction (circumferential direction). Thus, nine positions in total were measured. By averaging these measured values, Rz↓ (Rzb) of the fixing belt 1 in the lengthwise direction and Rz→ (Rzb') of the fixing belt 1 in the widthwise direction were obtained.

In the case of the pressure pad 3, the method of moving the probe of the roughness meter was similar to the above-described case of the fixing belt 1. Measurement was performed in a region where the pressure pad 3 was in contact with the fixing belt 1 at the following three positions in total: a position located at the center in the widthwise direction and the lengthwise direction; and positions offset from the center in the lengthwise direction by 150 mm toward the left and right ends in the lengthwise directions. By averaging these measured values, Rz↓ (Rzp) of the pressure pad 3 in the widthwise direction and Rz→ (Rzp') of the pressure pad 3 in the lengthwise direction were obtained.

(2-7) Paper-feeding Durability Evaluation

1) FIRST TO FOURTH EXAMPLES

In order to evaluate performance of the structure according to the present embodiment, the secured member 3*a* and the sliding layer 1*d* were produced with the roughnesses of the opposing surfaces of both the components adjusted as listed in Table 1 for first to fourth examples.

In order to check performance, modifications were made so that the fixing apparatus A according to the present embodiment was able to be installed in a color multi-function machine "imageRUNNER ADVANCE C7065" ("image RUNNER" is a trade mark) made by CANON KABUSHIKI KAISHA, and evaluation was performed. In this evaluation, 1.5 g of the lubricant (grease) g was applied to the secured member 3*a*. This multi-function machine can form images at least on plain paper, thick paper, and overhead transparency paper (OHT: transparent resin paper for overhead projector) as recording paper. The process speeds (fixing speeds) were, assuming that the process speed for plain paper is 1, ¼ for thick paper and ⅓ for OHT paper.

Under conditions of each of examples 1 to 4, a solid black image was continuously formed on each of 100 sheets of OHT paper. During image formation, whether or not noise due to stick-slip was generated was checked. In examples 1 to 4, no such problem was observed.

In addition, a solid black image was continuously formed on each of 100 sheets of OHT paper after 300,000 sheets of plain paper had been continuously fed. During these operations, generation of noise due to stick-slip was not observed. The results are listed in Table 1.

The upper limit of torque of the drive motor MT of the fixing apparatus A according to the present embodiment was 20 kgf·cm. A situation in which this upper limit torque was exceeded and the drive motor MT was stopped due to overload did not occur.

2) FIRST COMPARATIVE EXAMPLE

In a first comparative example, the fixing belt 1 that has the sliding layer 1*d* of the third example and the secured member 3*a* coated with a fluorine-based resin, PTFE, were used. The paper-feeding durability test was performed under the same conditions as those for first to fourth examples.

In the structure of the first comparative example, the secured member 3*a* was coated with a PTFE, the frictional coefficient of which is low. Thus, a situation, in which the upper limit of torque was exceeded and, as a result, the motor MT was stopped, did not occur. However, when printing on 100 sheets of OHT paper was performed after 300,000 sheets of plain paper had been fed, the above-described "squeal" phenomenon was observed.

The cause of this is thought to be the occurrence of stick-slip during printing on the OHT paper, which was processed at low speed, because the lubricant g expected to be held by the secured member 3*a* was repelled by the PTFE coating.

3) FIFTH EXAMPLE

In the fifth example, the fixing belt 1 that has the sliding layer 1*d* similar to that of the third example was used. The secured member 3*a* of the fifth embodiment was polished and adjusted so that Rz↓ in the widthwise direction was set to 0.5 μm, which is larger than 0.29 μm. The paper-feeding durability test was performed under the same conditions as those for first to fourth examples.

With the structure of the fifth example, the upper limit of torque was not exceeded. When continuous printing on 100 sheets of OHT paper was performed after 300,000 sheets of plain paper had been continuously fed, slight "squeal" was observed although the degree of it was practically negligible ("Yes/No" in Table 1).

The cause of this is thought to be the polyimide resin layer serving as the sliding layer 1*d* being polished (shaved) by irregularities of the secured member 3*a* because Rz↓ (Rzp) of the secured member 3*a* in the widthwise direction of the fixing belt 1 (fixing belt movement direction) was larger than 0.29 μm. When the fixing belt 1 was cut open and the inner surface thereof was checked after the paper-feeding durability test had been finished, it was observed that part of the sliding layer 1*d* was shaved and part of the base layer 1*a* was exposed from the sliding layer 1*d*.

4) SIXTH EXAMPLE

In a sixth example, the secured member 3*a* of the first example was used, and the sliding layer 1*d* was polished and adjusted so that Rz↓ of the sliding layer 1*d* in the widthwise direction was smaller than Rz→ of the sliding layer 1*d* in the lengthwise direction. The paper-feeding durability test was performed similarly to that performed in the above-described examples.

With the structure of the sixth example, a situation in which the upper limit of torque was exceeded and, as a result, the motor MT was stopped, did not occur. When continuous printing on 100 sheets of OHT paper was performed after 300,000 sheets of plain paper had been continuously fed, slight "squeal" was observed although the degree of it was practically negligible ("Yes/No" in Table 1). The cause of this is thought to be non-uniformity in the amount by which the lubricant g is held by the sliding layer 1*d* of the fixing belt 1 in the widthwise direction occurring because Rz→ of the sliding layer 1*d* in the lengthwise direction was larger than Rz↓ of the sliding layer 1*d* in the fixing belt 1 widthwise direction. As a result of the above-described nonuniformity, it is thought that shortage of the lubricant g partly occurred in the lengthwise direction, the sliding layer 1*d* slid against the secured member 3*a* without the lubricant g applied therebetween, and accordingly, slight stick-slip occurred.

5) SEVENTH EXAMPLE

In a seventh example, the sliding layer 1*d* of the third example was used, and the secured member 3*a* was polished and adjusted so that Rz→ of the secured member 3*a* in the lengthwise direction is smaller than Rz↓ of the secured member 3*a* in the widthwise direction. The paper-feeding durability test was performed similarly to that performed in the above-described examples.

With the structure of the seventh embodiment, when continuous printing on 100 sheets of OHT paper was performed after 300,000 sheets of plain paper had been continuously fed, slight "squeal" was observed although the degree of it was practically negligible ("Yes/No" in Table 1). The cause of this is thought to be non-uniformity in the amount by which the lubricant g is held by the secured member 3*a* in the lengthwise direction occurring because Rz↓ of the secured member 3*a* in the widthwise direction is larger than Rz→ of secured member 3*a* in the lengthwise direction. As a result of the above-described non-uniformity, it is thought that slight stick-slip occurred because shortage of the lubricant g partly occurred in the lengthwise direction and the sliding layer 1*d* slid against the secured member 3*a* without the lubricant g applied therebetween.

6) SECOND COMPARATIVE EXAMPLE

As a second comparative example, the sliding layer 1*d* side is coated with a fluorine-based resin (PTFE) and the secured member 3*a* similar to that in the first example was used. The sliding layer 1*d* and the secured member 3*a* were polished and adjusted so that Rz of the sliding layer 1*d* and Rz of the secured member 3*a* were set to as listed in Table 1. The paper-feeding durability test was performed similarly to that performed in the above-described examples.

With the structure of the second comparative example, when continuous printing on 100 sheets of OHT paper was performed after 300,000 sheets of plain paper had been continuously fed, "squeal" was observed.

The cause of this is thought to be the occurrence of stick-slip during printing on the OHT paper, which was processed at low speed, because the lubricant g expected to be held by the secured member 3*a* was repelled by the PTFE coating. When checking the secured member 3*a* after the paper-feeding durability test has been finished, it was observed that the PTFE resin coating layer was shaved and the stainless steel (SUS304) material was exposed.

TABLE 1

| | Pressure pad (secured member) | | | Fixing belt (sliding layer) | | | Paper-feeding durability test | |
|---|---|---|---|---|---|---|---|---|
| | Material | Rz↓ | Rz→ | Material | Rz↓ | Rz→ | Torque | Squeal |
| 1st example | SUS304 | 0.2 | 0.4 | PI | 0.1 | 0.01 | No | No |
| 2nd example | SUS304 | 0.2 | 0.4 | PI | 13 | 1.0 | No | No |
| 3rd example | SUS304 | 0.01 | 0.3 | PI | 4.0 | 0.5 | No | No |
| 4th example | SUS304 | 0.29 | 9.0 | PI | 4.0 | 0.5 | No | No |
| 5th example | SUS304 | 0.5 | 0.4 | PI | 4.0 | 0.5 | No | Yes/No |
| 6th example | SUS304 | 0.2 | 12 | PI | 1.3 | 4.0 | No | Yes/No |
| 7th example | SUS304 | 0.29 | 0.15 | PI | 4.0 | 0.5 | No | Yes/No |
| 1st comparative example | SUS304 PTFE | 0.2 | 0.15 | PI | 4.0 | 0.5 | No | Yes |
| 2nd comparative example | SUS304 | 0.2 | 0.4 | PTFE | 4.0 | 0.5 | No | Yes |

Second Embodiment

Figure 6:
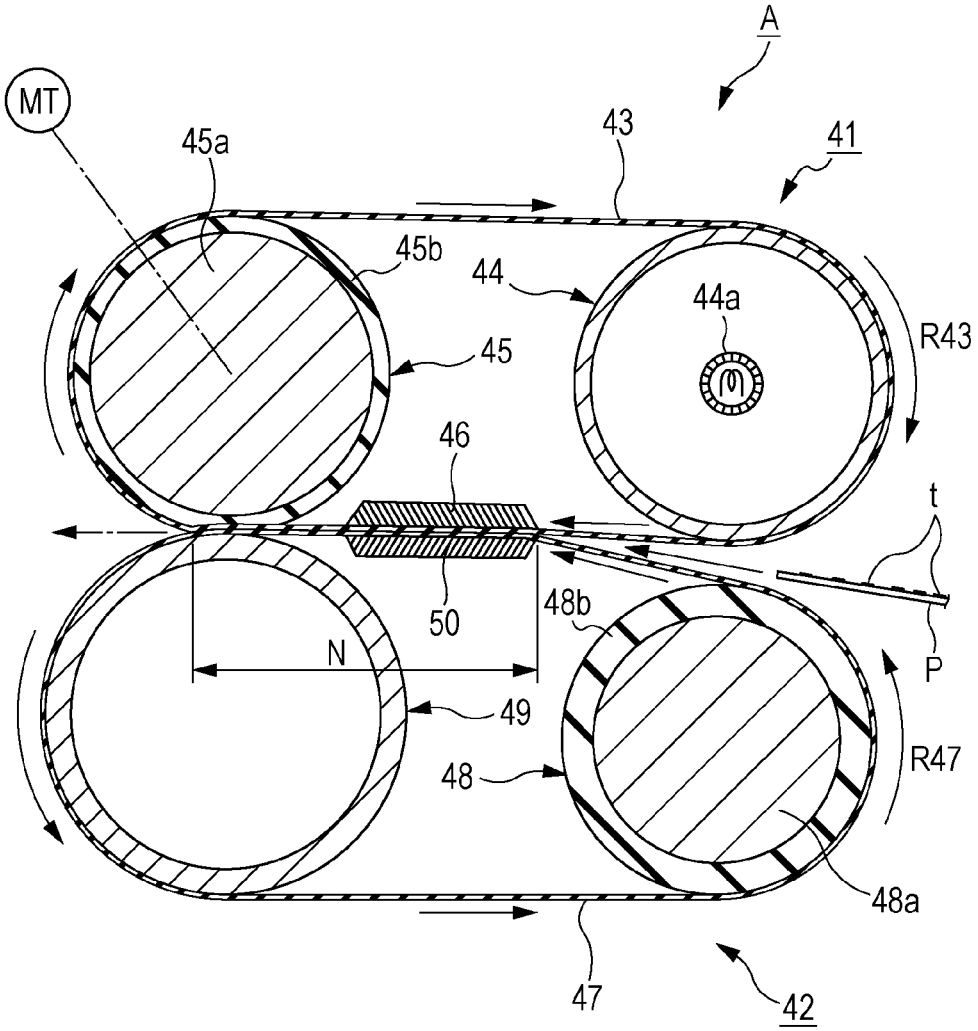
FIG. 6 is a schematic view of the structure of a fixing apparatus according to a second embodiment.

FIG. 6 is a schematic sectional view of a main portion of a fixing apparatus A according to a second embodiment. The fixing apparatus A includes a first belt unit 41 and a second belt unit 42 disposed one on top of the other. An endless first belt member 43 is rotatably provided in the first belt unit 41, and an endless second belt member 47 is rotatably provided in the second belt unit 42. The second belt unit 42 is an opposing member that forms a nip portion together with an outer surface of the first belt member 43 of the first belt unit 41. The first belt member 43 of the first belt unit 41 and the second belt member 47 of the second belt unit 42 respectively serve as a fixing belt and a pressure belt. The fixing belt 43 and the pressure belt 47 are in pressure contact with each other so as to form the fixing nip portion N.

The recording paper P carrying the unfixed toner image t is conveyed while being nipped in this fixing nip portion N. The unfixed toner image t is heated, pressed, and fixed to the surface of the recording paper P as a fixed image by heat of the heated fixing belt 43 and the pressure at the fixing nip portion N.

More specifically, the first belt unit 41 includes the above-described fixing belt 43, a heating roller 44, a fixing roller 45, a fixing pad 46, and so forth. The fixing belt 43 is looped over the heating roller 44 and the fixing roller 45. The fixing pad 46 serves as a non-rotatable pressure applying member (first secured member).

More specifically, the second belt unit 42 includes the above-described pressure belt 47, a tension roller 48, a pressure roller 49, a pressure pad 50, and so forth. The pressure belt 47 is looped over the tension roller 48 and the pressure roller 49. The pressure pad 50 serves as a non-rotatable pressure applying member (second secured member).

1) Fixing Belt 43

The fixing belt 43 has a Ni base layer and an elastic layer. An inner diameter and the thickness of the base layer are 40 mm and 50 μm, respectively. The elastic layer having a thickness of 300 μm is provided at an outer circumference of the base layer. As the material of the base layer, stainless steel or a resin such as polyimide may be used instead of Ni.

As the material of the elastic layer, a known elastic material may be used. Examples of known elastic materials include, for example, silicone rubber and fluoro rubber. In the present embodiment, the elastic layer is formed of a silicone rubber, the hardness and heat conductivity of which are JIS A hardness of 20 and 0.8 W/mK, respectively. Deformation of this elastic layer prevents the recording paper P from being caught by the fixing belt 43, and good separating performance, with which the recording paper P is separated from the fixing belt 43, can be obtained.

Furthermore, a fluorine-based resin layer (for example, a PFA layer or a PTFE layer) having a thickness of 30 μm is provided at an outer circumference of the elastic layer as a mold release surface layer. As is the case with the third example, a polyimide coating having a thickness of 15 μm is provided as the sliding layer on an inner surface of the base layer. Rz in the widthwise direction is set to 4.0 μm and Rz in the lengthwise direction is set to 0.5 μm.

2) Heating Roller 44

The heating roller 44 together with the fixing roller 45 supports the fixing belt 43 so that the fixing belt 43 is looped over the heating roller 44 and the fixing roller 45. The heating roller 44 is a heating unit that heats the fixing belt 43. The heating roller 44 includes an iron hollow roller having an outer diameter of 20 mm, an inner diameter of 18 mm, and a thickness of 1 mm. A halogen heater 44*a* is disposed as a heat source (heating unit) inside the heating roller 44. Both ends of the heating roller 44 are rotatably supported between side plates of an apparatus frame (not shown) using bearing members. The heating roller 44 is urged to move in a direction separating from the fixing roller 45 so as to function as a tension roller for the fixing belt 43.

3) Fixing Roller 45

The fixing roller 45 together with the heating roller 44 supports the fixing belt 43 so that the fixing belt 43 is looped over the fixing roller 45 and the heating roller 44. The fixing roller 45 is a drive roller that rotates the fixing belt 43. The fixing roller 45 is disposed parallel to and downstream of the heating roller 44 in the recording paper conveying direction. Both ends of the fixing roller 45 are rotatably supported between the side plates of the apparatus frame (not shown) using bearing members. The fixing roller 45 is driven by the motor (drive source) M, and due to friction generated between the silicone rubber surface of the fixing roller 45 and the inner surface Ni layer of the fixing belt 43, the fixing belt 43 is rotated.

The fixing roller 45 is a high-friction elastic roller having an outer diameter of 20 mm and has a cored bar 45*a*, which is formed of an iron alloy roller having a diameter of 18 mm, and a silicone rubber layer having a thickness of 1 mm as an elastic layer 45*b* at the circumferential surface of the cored bar 45*a*. The silicone rubber layer has a hardness of JIS A hardness of 15 and heat conductivity of 0.8 W/mK.

With such an elastic layer 45*b*, a drive force input from the motor MT to the fixing roller 45 through a gear train can be transmitted to the fixing belt 43, and a fixing nip portion that ensures good separating performance, with which the recording paper P is separated from the fixing belt 43, can be formed. By using the silicone rubber layer, heat transfer to the inside of the fixing roller 45 is decreased, thereby producing an effect by which warm-up time is decreased. Although it will be described later, the pressure at the fixing nip portion is set such that a region of the fixing nip portion formed by the fixing roller 45 becomes the maximum.

4) Fixing Pad 46

The fixing pad 46 presses the fixing belt 43 toward the pressure belt 47. The fixing pad 46 is disposed so as to be in contact with the inner surface of a lower run of the fixing belt 43, which is looped over the heating roller 44 and the fixing roller 45. The fixing pad 46 is disposed near the fixing roller 45 without being in contact with the fixing roller 45. In the present embodiment, the minimum distance (gap) between the fixing roller 45 and the fixing pad 46 is set to 5 mm.

As described above, the fixing roller 45 is made to be an elastic roller having a high fractional coefficient so as to satisfactorily function as a drive roller. The fixing pad 46 is disposed near this fixing roller 45 without being in contact with the fixing roller 45. Thus, conveying torque required for driving the fixing roller 45 is prevented from excessively increasing, and accordingly, a conveying property of the fixing belt 43 can be stabilized.

The fixing roller 45 and the fixing pad 46 are positioned using side plates (not shown). A lower surface of the fixing pad 46 is positioned 0.2 mm higher relative to a lower surface of the fixing roller 45 with respect to a direction connecting the axial centers of the pressure roller 49 and the fixing roller 45.

In the present embodiment, the fixing pad 46 is formed of metal, more specifically, a stainless steel (SUS304) member having an about 12 mm width (with respect to the recording paper conveying direction). As is the case with the first example, Rz of the fixing pad 46 in the widthwise direction is set to 0.2 μm and Rz of the fixing pad 46 in the lengthwise direction is set to 0.4 μm. The same amount of the same lubricant g as those in the first example is applied to the fixing pad 46.

5) Pressure Belt 47

The pressure belt 47 uses a nickel endless belt having an inner diameter of 40 mm and a thickness of 50 μm as a base layer. A polyimide coating having a thickness of 15 μm is provided on an inner surface of the pressure belt 47 as a smoothing layer in order to improve the sliding property. A PFA tube having a thickness of 30 μm, which is formed of a fluorine-based resin, is provided on a surface of the pressure belt 47 as a mold release surface layer.

6) Tension Roller 48

The tension roller 48 imparts tension to the pressure belt 47 looped over the tension roller 48 and the pressure roller 49. The tension roller 48 is a heat insulating roller having an outer diameter of 20 mm. The tension roller 48 has a cored bar 48*a*, which is formed of a 16 mm diameter iron alloy, and a silicone sponge layer 48*b* provided on an outer circumferential surface of the cored bar 48*a*. The silicone sponge layer 48*b* is provided so as to decrease heat conductivity, thereby decreasing heat conduction from the pressure belt 47. Both ends of the tension roller 48 are rotatably supported between the side plates of the apparatus frame using bearing members. The tension roller 48 as a tension roller for the pressure belt 47 is urged to move in a direction separating from the pressure roller 49.

7) Pressure Roller 49

The pressure roller 49 together with the tension roller 48 supports the pressure belt 47 so that the pressure belt 47 is looped over the pressure roller 49 and the tension roller 48. The pressure roller 49 includes an iron alloy rigid roller, the frictional coefficient of which is low. The pressure roller 49 has an outer diameter of 23.5 mm, an inner diameter of 19.5 mm, and a thickness of 2 mm. Both end sides of the rotational axis of the pressure roller 49 are pressed toward the fixing roller 45 at predetermined pressures by a pressing mechanism. Thus, the fixing roller 45 and the pressure roller 49 are in pressure contact with each other against the elastic property of the elastic layer 45*b* with the fixing belt 43 and the pressure belt 47 nipped therebetween, thereby forming a roller nip surface.

8) Pressure Pad 50

The pressure pad 50 presses the pressure belt 47 toward the fixing belt 43. The pressure pad 50 is disposed so as to be in contact with the inner surface of an upper run of the pressure belt 47, which is looped over the tension roller 48 and the pressure roller 49. The pressure pad 50 is disposed without being in contact with the rigid pressure roller 49. As is the case with the first example, the pressure pad 50 is formed of stainless steel (SUS304), Rz of the pressure pad 50 in the widthwise direction is 0.2 μm and Rz of the pressure pad 50 in the lengthwise direction is 0.4 μm. The same amount of the same lubricant g as those in the first example is applied to the pressure pad 50.

The fixing belt 43 and the pressure belt 47 are nipped between the fixing pad 46 and the pressure pad 50 and in pressure contact with each other, thereby forming the fixing nip portion N between the fixing belt 43 and the pressure belt 47. In the present embodiment, pressure applied by the fixing roller 45 and the pressure roller 49 and pressure applied by the fixing pad 46 and the pressure pad 50 cause the fixing nip portion N to be formed between the fixing belt 43 and the pressure belt 47. The fixing nip portion N has a large nip width of about 18 mm with respect to the recording paper conveying direction. In the fixing nip portion N, the pressure at the fixing nip portion is set such that the pressure in a region of the fixing nip portion, the region being a region where the fixing roller 45 and the pressure roller 49 is in pressure contact with each other, becomes the maximum.

Since the fixing nip portion N has such a larger nip width, fixing of images can be sufficiently performed even when the speed of image formation is increased. Furthermore, the fixing belt 43 and the pressure belt 47, which are endless belts, are used on both the fixing and pressing sides as members related to fixing. Thus, in comparison with related art, heat capacity can be decreased. This, as a result, contributes to reduction of warm-up time (a time required from when a main power as a hardware switch of the image forming apparatus is turned on to when a state, in which fixing operation can be performed, is entered).

9) Fixing Sequence

The fixing belt 43 is, at least while the image forming is being performed, rotated clockwise as indicated by an arrow R43 due to rotation of the fixing roller 45 caused by the motor MT. In order to form loops of sheets of the recording paper P, the circumferential speed of the fixing belt 43 is set to be slightly lower than the conveying speed of the recording paper conveyed from the image forming units side.

The pressure belt 47 is driven by the fixing belt 43 so as to be rotated counterclockwise as indicated by an arrow R47. Here, the most downstream portion of the fixing nip (portion where a pressure distribution (in the sheet conveying direction) is the maximum in the fixing nip) is formed by nipping the fixing belt 43 and the pressure belt 47 between a pair of the rollers, that is, the fixing roller 45 and the pressure roller 49, so as to convey the recording paper P. Thus, the belts can be prevented from slipping. In the present embodiment, the circumferential speed of the fixing belt 43 is set to 300 mm/sec, at which 70 A4-sized full-color images can be fixed in a minute.

The heating roller 44 is heated by heat from the halogen heater 44*a* when the fixing belt 43 is being rotated. The halogen heater 44*a* heats up by power supplied from a power supply circuit (not shown) controlled by a control circuit unit (not shown). The fixing belt 43 is heated by the heated heating roller 44 while being rotated.

The surface temperature of the fixing belt 43 is detected by a temperature sensor (not shown), and electrical information regarding the fixing belt surface temperature is input to the control circuit unit. The control circuit unit changes power to be supplied from the power supply circuit to the halogen heater 44*a* in accordance with received temperature data so that the fixing belt surface temperature detected by the temperature sensor is adjusted so as to be maintained at a predetermined fixing temperature.

In a state in which the temperature of the fixing belt 43 has been increased and adjusted to the predetermined fixing temperature, a sheet of recording paper P that carries an unfixed toner image t is conveyed into the fixing nip portion N between the fixing belt 43 and the pressure belt 47. The recording paper P is introduced with the surface thereof, on which the unfixed toner image t is carried, faces the fixing belt 43 side. The unfixed toner image t carried by the recording paper P is nipped and conveyed while being in tight contact with the outer circumferential surface of the fixing belt 43. Thus, the unfixed toner image t, to which heat is imparted mainly from the fixing belt 43 and a pressing force is applied, is fixed onto the surface of the recording paper P.

Since the fixing roller 45 inside the fixing belt 43 is an elastic roller having the rubber elastic layer 45*b* and the pressure roller 49 inside the pressure belt 47 is an iron alloy rigid roller, deformation of the fixing roller 45 is large at the exit of the fixing nip portion N formed by the fixing belt 43 and the pressure belt 47. As a result, the fixing belt 43 is also significantly deformed, and the recording paper P that carries the toner image undergoes curvature separation due to a property of the recording paper P that restores the paper P to its original shape, and is separated from the fixing belt 43.

As is the case with the first to fourth examples, modifications were made so that the fixing apparatus A according to the second embodiment was able to be installed in an image forming apparatus and the paper-feeding durability test was performed. In the present embodiment, a situation in which the upper limit of torque was exceeded, and as a result, the motor MT was stopped did not occur and the "squeal" phenomenon was not observed, either.

Third Embodiment

Figure 7:
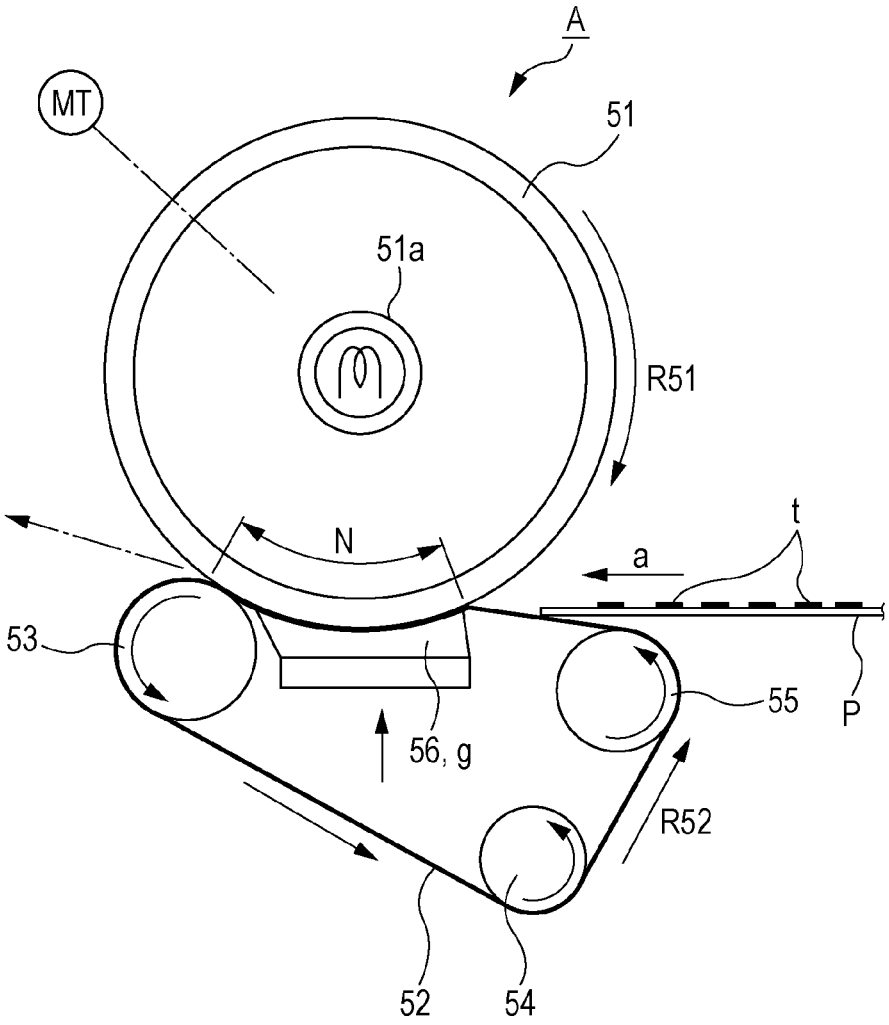
FIG. 7 is a schematic view of the structure of a fixing apparatus according to a third embodiment.

FIG. 7 illustrates an alternative example of the structure of a fixing apparatus to which a belt method is applied. In the apparatus A, a heating roller 51 serves as a fixing member, an outer surface of which is in contact with a pressure belt 52 that serves as a rotatably provided endless belt member so as to form the fixing nip portion N that is large in the recording paper conveying direction a. The heating roller 51 and the pressure belt 52 is in contact with each other such that part of the pressure belt 52, the part being a part in contact with the heating roller 51, is bent in the recording paper conveying direction a.

The pressure belt 52 is supported so that the pressure belt 52 is looped over a plurality of suspending rollers 53 to 55. A pressure pad 56 is disposed inside the pressure belt 52 as a non-rotatable pressure applying member (secured member). The pressure pad 56 is in contact with an inner surface of the pressure belt 52 and is pressed toward the heating roller 51 that serves as an opposing member through the pressure belt 52. The pressure pad 56 causes the pressure belt 52 to be in contact with the outer surface of the heating roller 51 such that part of the pressure belt 52, the part being a part in contact with the pressure pad 56, is bent in the recording paper conveying direction a, thereby forming the fixing nip portion N having a large width in the recording paper conveying direction a.

The heating roller 51 is rotated clockwise as indicated by an arrow R51 by the motor MT at a predetermined circumferential speed. Furthermore, the inside of the heating roller 51 is heated by a halogen heater 51*a*, thereby adjusting the surface temperature to a predetermined temperature. The pressure belt 52 is driven by rotation of the heating roller 51 so as to be rotated counterclockwise as indicated by an arrow R52. The recording paper P that carries the unfixed toner image t is introduced into the fixing nip portion N so as to be nipped and conveyed. Thus, the unfixed toner image t, to which heat is imparted from the heating roller 51 and a pressing force is applied, is fixed onto the surface of the recording paper P.

The pressure pad 56 is formed of metal and the ten-point average roughness Rz↓ at a slide contact portion against which the inner surface of the pressure belt 52 slides is equal to or smaller than 0.29 μm in a belt member movement direction and smaller than the ten-point average roughness Rz→ in a direction perpendicular to the belt member movement direction. The lubricant g is applied to the slide contact portion in order to provide lubricating property. The ten-point average roughness Rz↓ of the inner surface of the pressure belt 52 is equal to or smaller than 1.3 μm in the belt member movement direction and larger than the ten-point average roughness Rz→ in a direction perpendicular to the belt member movement direction.

As is the case with the first to fourth examples, modifications were made so that the fixing apparatus A according to the third embodiment was able to be installed in an image forming apparatus and the paper-feeding durability test was performed. In the present embodiment, a situation in which the upper limit of torque was exceeded, and as a result, the motor MT was stopped did not occur and the "squeal" phenomenon was not observed, either.

Notes

1) The image heating apparatus according the present invention is not necessarily used as a fixing apparatus as described in the embodiments. The image heating apparatus may also be useful as an image modification apparatus that modifies glossiness and the like of an image fixed or temporarily fixed (fixed image or half-fixed image) on recording paper (sheet).

2) The opposing member that forms the nip portion together with the outer surface of the endless belt between the opposing member and the outer surface of the endless belt is not necessarily a rotating member when the endless belt is directly driven by a driving unit. The opposing member may be in the form of a non-rotating member such as a small pad or a plate member having a surface (surface in contact with a heating member or recording paper), the frictional coefficient of which is small.

3) The heating mechanism that heats the endless belt or the opposing member is not limited to a heating mechanism to which an electromagnetic induction heating method is applied. Another known heating mechanism such as a halogen heater or a fixed ceramic heater may be used.

4) The image forming method of the image forming apparatus is not limited to an electrophotographic printing method. An electrostatic recording method or a magnetic recording method may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-040369 filed Feb. 27, 2012, which is hereby incorporated by reference herein in its entirety.

What is claimed is:

1. An image heating apparatus comprising:

an endless belt configured to heat a toner image on a sheet in a nip portion;

an opposing member disposed opposite the endless belt and configured to form the nip portion cooperatively with the endless belt; and a pressure pad configured to press the endless belt toward the opposing member, the pressure pad having a metal slide contact portion configured to slide against an inner surface of the endless belt with rotation of the endless belt; and a lubricant existed between the slide contact portion and the inner surface of the endless belt, wherein, when a surface roughness of the slide contact portion in a movement direction of the endless belt is denoted by Rzp and a surface roughness of the inner surface of the endless belt in the movement direction of the endless belt is denoted by Rzb, the following relationship is satisfied:

$$Rzp<Rzb.$$

2. The image heating apparatus according to claim 1, wherein the following relationships are satisfied:

$$1.3\ \mu m \leq Rzb, \text{ and } Rzp \leq 0.29\ \mu m.$$

3. The image heating apparatus according to claim 2, wherein, when a surface roughness of the slide contact portion in a width direction of the endless belt is denoted by Rzp' and a surface roughness of the inner surface of the endless belt in the width direction of the endless belt is denoted by Rzb', the following relationships are satisfied:

$$Rzp<Rzp', \text{ and } Rzb'<Rzb.$$

4. The image heating apparatus according to claim 3,wherein a Vickers hardness of the inner surface of the endless belt is smaller than a Vickers hardness of the slide contact portion.

5. The image heating apparatus according to claim 1, wherein the endless belt has a base layer and a surface layer, the surface layer being provided on an inner surface side relative to the base layer, the surface layer being formed of polyimide resin.

6. The image heating apparatus according to claim 1, wherein the pressure pad has a holding portion that holds the slide contact portion.

7. The image heating apparatus according to claim 6, wherein the holding portion has a heat insulating member.

8. The image heating apparatus according to claim 1, further comprising:

a drive mechanism that rotates the endless belt.

9. The image heating apparatus according to claim 8, wherein the opposing member is a roller that functions as the drive mechanism.

10. The image heating apparatus according to claim 1, further comprising:

a heating mechanism configured to heat the endless belt.

11. The image heating apparatus according to claim 10, wherein the heating mechanism includes an excitation coil configured to heat the endless belt by electromagnetic induction.

* * * * *